US006277499B1

(12) United States Patent
Beers et al.

(10) Patent No.: US 6,277,499 B1
(45) Date of Patent: Aug. 21, 2001

(54) OXIDATION RESISTANT COATINGS FOR COPPER

(75) Inventors: Russell A. Beers; Abdus S. Khan; Allan A. Noetzel, all of Palm Beach Gardens, FL (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 07/872,562

(22) Filed: Apr. 23, 1992

(51) Int. Cl.[7] ..... B22F 7/02

(52) U.S. Cl. ..... 428/548; 428/553; 428/557; 428/567; 428/668; 428/674; 428/675; 427/405

(58) Field of Search ..... 427/250, 405, 427/455, 456; 204/192.1; 428/548, 553, 557, 567, 668, 674, 675; 75/245, 246, 247

(56) References Cited

U.S. PATENT DOCUMENTS

| | | | | |
|---|---|---|---|---|
| 3,053,511 | * | 9/1962 | Godfrey | 257/154 |
| 3,238,025 | * | 3/1966 | Pendleton et al. | 29/194 |
| 3,502,449 | * | 3/1970 | Phillips | 29/195 |
| 3,810,287 | * | 5/1974 | Pryor et al. | 29/191.6 |
| 4,013,487 | * | 3/1977 | Ramqvist et al. | 148/16.5 |
| 4,189,331 | * | 2/1980 | Roy | 148/6.31 |
| 4,196,237 | * | 4/1980 | Patel et al. | 427/419.1 |
| 4,916,026 | * | 4/1990 | Bergmann et al. | 428/555 |
| 5,063,117 | * | 11/1991 | Suda et al. | 428/610 |

FOREIGN PATENT DOCUMENTS

| | | | | |
|---|---|---|---|---|
| 2069007 | * | 8/1981 | (GB) | 428/548 |
| 60-200990 | * | 10/1985 | (JP) | 428/548 |
| 61-130489 | * | 6/1986 | (JP) | 428/553 |

* cited by examiner

*Primary Examiner*—Kathryn Gorgos
*Assistant Examiner*—Chrisman D. Carroll

(57) ABSTRACT

A method is taught for protecting copper and copper-based composites from high temperature oxidation, by the application thereto of a cobalt-based alloy diffusion barrier and a copper-aluminum alloy protective outer layer.

16 Claims, 3 Drawing Sheets

OXIDATION RESISTANT COATINGS FOR COPPER

BACKGROUND OF THE INVENTION

1. Field of the Invention

This invention relates to a method for protecting copper and copper-based composites or monolithic structures from oxidation at elevated temperatures.

2. Description of the Prior Art

Copper alloys have generally superior thermal and electrical conductivity, especially pure copper or alloys having only minimal additions. Unfortunately, such materials also tend to oxidize rapidly at elevated temperatures, thus limiting their applicability for such purposes as high temperature heat exchangers, actively cooled gas flow channels, and air frame structures. For such applications, the alloys must have high strength and adequate oxidation resistance. Strengthening of copper alloys may be accomplished by compositing with a second metallic phase, such as niobium, tantalum, etc., known as microcompositing, or by reinforcement by high strength fibers, such as graphite.

Prior to the present invention, applicants have been unaware of any viable method to protect copper substrates for use at temperatures exceeding approximately 800° F. It has recently been proposed, however, that copper and copper alloys, as well as copper-graphite fiber composites, be utilized for very high temperature heat exchange in rocket engines and hypersonic combustion engines. To achieve this, it was found necessary to provide a means to protect such materials from oxidation in the temperature ranges anticipated, e.g. 1200° F. or higher. Moreover, for such utility, it was also necessary to provide protective coatings which would be compatible with the coefficient of thermal expansion of the substrate, and not substantially lower the thermal conductivity of the structure, while exhibiting fatigue resistance and resistance to diffusion.

SUMMARY OF THE INVENTION

It is an object of the present invention to provide a means to protect a predominately copper substrate from high temperature oxidation by application of a protective coating to the surface thereof. It is also an object of the present invention to provide high temperature heat exchange media comprising copper having a protective layer of a highly oxidation resistant material thereupon.

These and other objects of the present invention have been achieved by application of a copper-aluminum alloy protective layer to the surface of a copper substrate, utilizing specifically selected barrier layer materials to prevent diffusion of the aluminum from the coating layer into the substrate. In addition, it is critical that the barrier layers utilized be microstructurally stable, resistant to oxygen and aluminum diffusion, tolerant to strain, and retain ductility at elevated temperatures, while not dissolving in either the copper substrate or the copper-aluminum alloy coating.

BRIEF DESCRIPTION OF THE DRAWING(S)

DESCRIPTION OF THE PREFERRED EMBODIMENTS

Figure 1:
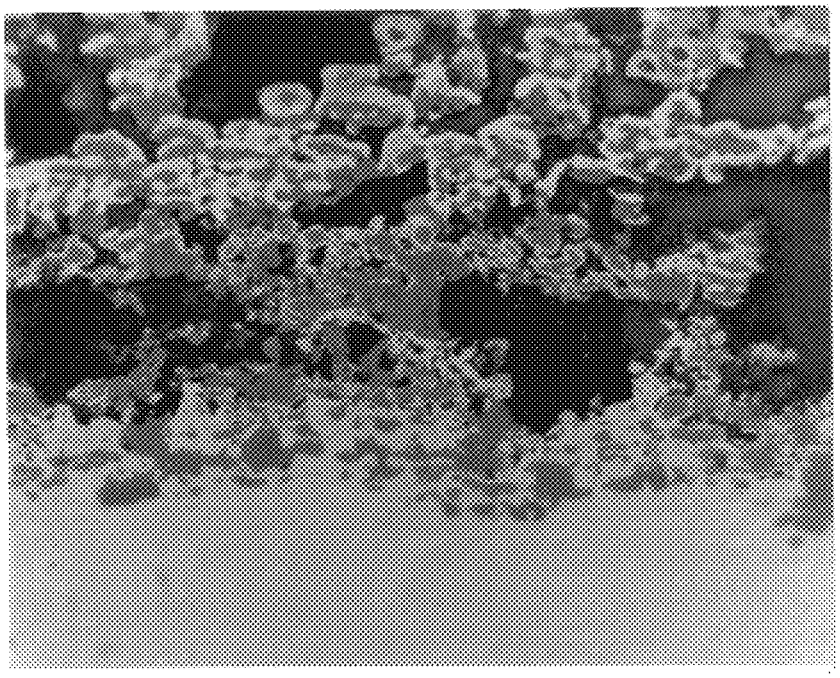
FIG. 1 is a photomicrograph of a copper-niobium substrate subjected to high temperature oxidation.

Aluminum containing materials are known to be suitable coating materials for high temperature oxidation resistance, due to the rapid formation of aluminum oxide, which is adherent and resistant to further oxidation. However, due to the necessity to maintain the thermal conductivity of the copper substrates under consideration, it was determined that copper alloy coatings containing minor amounts of aluminum could be used, wherein the aluminum is present in sufficient quantity to form a protective alumina or cupric aluminate scale. The coating material may fall generally among those copper alloys containing from 1 to 8 weight percent aluminum and from 0 to 5 weight percent silicon. Exemplary coating materials include copper—8 weight percent aluminum (Cu—8Al), copper—4 weight percent aluminum—3 weight percent silicon (Cu—4Al—3Si), copper—3 weight percent aluminum—2 weight percent silicon (Cu—3Al—2Si).

However, since copper substrates rapidly dissolve aluminum and silicon from coating layers by diffusion, particularly at elevated temperatures, it was determined that it was necessary to provide a barrier layer between the copper containing substrate and the copper-aluminum alloy oxidation resistant coating material. Moreover, the selection of an appropriate barrier layer material required that such material have a coefficient of thermal expansion as closely matched to that of both the substrate and the protective outer layer as possible, so as to avoid cracking and delamination of the final structure. Thus, a number of specific criteria have been established for the barrier layer: first, the barrier layer must provide protection against the diffusion of aluminum and silicon; secondly, the barrier layer has to be resistant to oxidation itself; thirdly, the barrier layer has to exhibit thermal expansion characteristics similar to those of copper and copper alloys containing a small amount of aluminum, or have sufficient ductility to overcome the stresses caused by differences in thermal expansion between the barrier layer and the substrate, and between the barrier layer and the protective coating; and finally, the barrier layer material must be capable of being applied uniformly to the substrate in very thin layers. These critical criteria have been found to be met by two cobalt-based alloys: L-605 (Haynes 25), nominally comprising cobalt, 20 weight percent chromium, 10 weight percent nickel, 0.10 weight percent carbon, 15 weight percent tungsten, and 1.5 weight percent manganese; and, WI-52, nominally comprising cobalt, 21.0 weight percent chromium, 0.45 weight percent carbon, 1.75 weight percent iron, 11.0 weight percent tungsten, and 2.0 weight percent niobium or tantalum. In addition, other cobalt alloys, such as Mar-M 302, comprising cobalt, 21.5 weight percent chromium, 10 weight percent tungsten, 9 weight percent tantalum, 1 weight percent iron, 0.25 weight percent zirconium, and 0.85 weight percent carbon, may be utilized. Chromium, and chromium alloys, which are known to be oxidation resistant and resistant to interlayer diffusion, but have thermal expansion coefficients considerably below those of the cited cobalt alloys, may be used as diffusion layers for graphite reinforced copper substrates, where the expansion coefficients have been significantly decreased by the presence of the reinforcement media.

The substrates to which the present invention applies may comprise copper and copper alloys suitable for use as heat exchange media, including microcomposited and reinforced copper and copper alloys. Exemplary of such materials are oxygen free high conductivity copper (OFHC copper), copper—1 weight percent chromium—2.6 weight percent hafnium, copper—15 volume percent niobium, and copper—15 volume percent tantalum.

The barrier layer and the protective coating may be applied to the substrate in any appropriate manner by which thin adherent coatings are obtained, such as by plasma spray, sputtering, arc vapor deposition, and chemical vapor deposition. The preferred deposition method is by low temperature arc vapor deposition, or by the cathodic/steered arc process. Coating thicknesses on the order of from about 0.1 mils to about 2 mils are acceptable, with thicknesses of from about 0.2 to about 0.5 mils being preferred for the diffusion barrier. The thickness of the protective layer may be from about 0.5 to about 4 mils, with a thickness of from about 1 to about 2 mils being preferred.

EXAMPLES

An uncoated copper substrate, reinforced by 15 volume percent niobium, was subjected to 1500° F. in air for a period of 200 hours. FIG. 1 is a photomicrograph of the near surface condition of this sample, illustrating severe oxidation of the copper and the niobium reinforcement.

Figure 2:
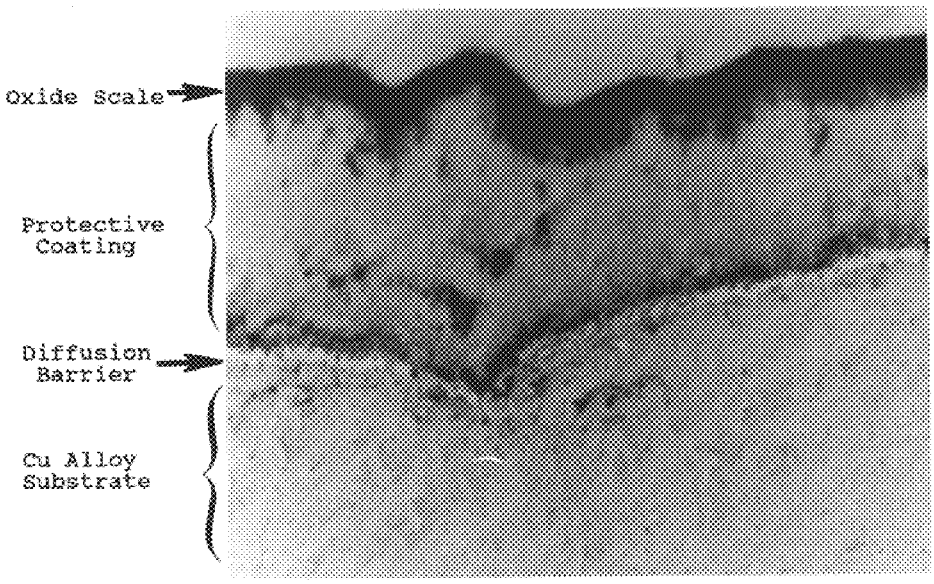
FIG. 2 is a photomicrograph of a copper alloy bearing a protective coating and diffusion barrier in accordance with this invention, after being subjected to conditions expected to result in high temperature oxidation.

A copper alloy comprising Cu—1Cr—2.6Hf was coated with a L-605 cobalt alloy diffusion barrier, to a thickness of about 0.2 mils, by cathodic arc deposition. A protective outer layer of Cu—8Al was then applied by cathodic arc deposition, to a thickness of about 1.5 mils. FIG. 2 is a photomicrograph of this coated substrate after exposure to 1500° F. air for 100 hours. It may be seen that a dense scale has formed at the surface, there is relatively little interdiffusion between layers, and no internal oxidation of the substrate has occurred.

Figure 3:
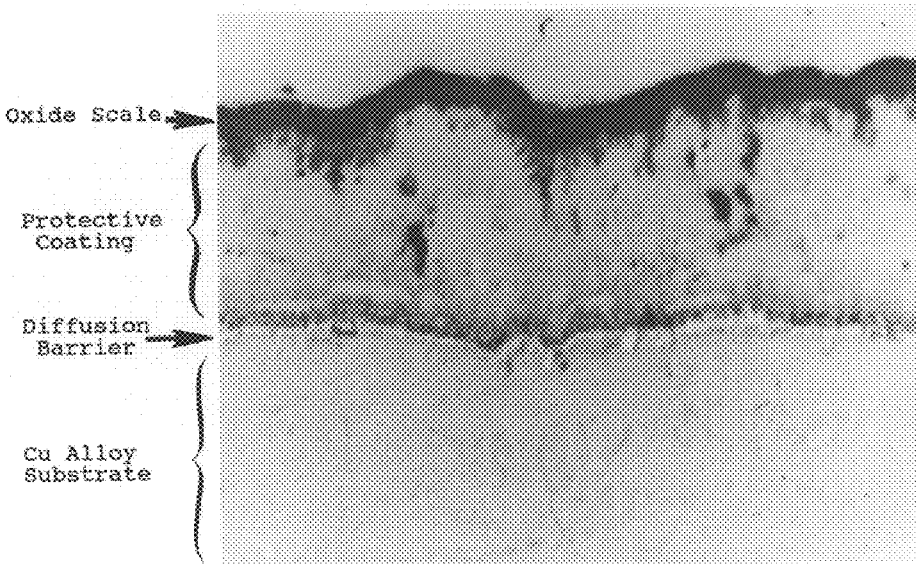
FIG. 3 is a photomicrograph of another copper alloy bearing a protective coating and diffusion barrier in accordance with this invention, after being subjected to conditions expected to result in high temperature oxidation.

Similarly, FIG. 3 illustrates a Cu—1Cr—2.6Hf substrate having a diffusion barrier of WI-52 cobalt alloy, approximately 0.1 mil thick, and an approximately 1.7 mil thick protective coating of Cu—8Al, both applied by cathodic arc deposition. After 100 hours of exposure to 1500° F. air, a dense adherent scale is visible, with minimal interlayer diffusion, and no internal oxidation of the substrate.

FIGS. 1 through 3 demonstrate the exceptional high temperature oxidation resistance obtained by use of the present invention, comprising application of a diffusion barrier to the copper substrate, followed by application of an aluminum containing copper alloy outer layer.

Test samples were prepared for high cycle fatigue testing. These samples comprised uncoated Cu—15Nb, Cu—8Al coated Cu—15Nb, Cu—8Al coated Cu—15Nb with L-605 diffusion barrier, and Cu—8Al coated Cu—15Nb with WI-52 diffusion barrier. These samples were tested by reverse bending cantilever beam at room temperature to establish the extent of fatigue debit resulting from application of the protective layers of the present invention. It was found that neither the coatings nor the application technique resulted in a measurable change in fatigue properties.

Fluidized bed thermal cycling was conducted on samples prepared as set forth above, both with and without diffusion barrier, to assess the effect of thermal expansion mismatch. In these tests, samples were rapidly cycled between two fluidized beds, one containing aerated alumina sand heated to 1200° F., and the other containing aerated alumina sand at room temperature. The test cycle was for 30 seconds in each bath, for a total of 201 cycles. The samples demonstrated no delamination or cracking of the applied coatings, illustrating excellent adherence between layers, and the relatively slight mismatches of the thermal expansion of the layers.

It is understood that the above description of the present invention is susceptible to various modifications, changes, and adaptations by those skilled in the art, and that the same are to be considered to be within the scope of the present invention, which is set forth by the claims which follow.

What is claimed is:

1. A method for the protection of a predominately copper substrate from oxidation at high temperatures, said substrate selected from the group consisting of OFHC copper, copper alloys, microcomposited copper, and graphite-reinforced copper alloys, said method comprising applying to said copper substrate a diffusion barrier comprising cobalt, 20 weight percent chromium, 10 weight percent nickel, 0.10 weight percent carbon, 15 weight percent tungsten, and 1.5 weight percent manganese, and applying to said diffusion barrier a protective outer layer comprising a copper alloy containing a minor amount of aluminum.

2. A method as set forth in claim 1, wherein said protective outer layer comprises a copper alloy containing from 1 to 8 weight percent aluminum and from 0 to 5 weight percent silicon.

3. A method as set forth in claim 2, wherein said protective outer layer comprises copper and 8 weight percent aluminum.

4. A method as set forth in claim 1, wherein the diffusion barrier and the protective outer layer are applied by cathodic arc deposition.

5. A method as set forth in claim 4, wherein said diffusion barrier is from about 0.1 to about 2 mils in thickness, and said protective outer layer is from about 0.5 to about 4 mils in thickness.

6. A method for the protection of a predominately copper substrate from oxidation at high temperatures, said substrate selected from the group consisting of OFHC copper, copper alloys, microcomposited copper, and graphite-reinforced copper alloys, said method comprising applying to said copper substrate a diffusion barrier comprising cobalt, 21.0 weight percent chromium, 0.45 weight percent carbon, 1.75 weight percent iron, 11.0 weight percent tungsten, and 2.0 weight percent niobium or tantalum, and applying to said diffusion barrier a protective outer layer comprising a copper alloy containing a minor amount of aluminum.

7. A method as set forth in claim 6, wherein said protective outer layer comprises a copper alloy containing from 1 to 8 weight percent aluminum and from 0 to 5 weight percent silicon.

8. A method as set forth in claim 7, wherein said protective outer layer comprises copper and 8 weight percent aluminum.

9. A method as set forth in claim 6, wherein the diffusion barrier and the protective outer layer are applied by cathodic arc deposition.

10. A method as set forth in claim 9, wherein said diffusion barrier is from about 0.1 to about 2 mils in thickness, and said protective outer layer is from about 0.5 to about 4 mils in thickness.

11. A structure comprising a copper substrate selected from the group consisting of OFHC copper, copper alloys, microcomposited copper, and graphite-reinforced copper alloys, a cobalt alloy diffusion barrier comprising cobalt, 20 weight percent chromium, 10 weight percent nickel, 0.10 weight percent carbon, 15 weight percent tungsten, and 1.5 weight percent manganese, said diffusion barrier being from about 0.1 to about 2 mils in thickness, and a protective outer layer consisting essentially of copper, from about 1 to about 8 weight percent aluminum, and from 0 to about 5 weight percent silicon.

12. A structure as set forth in claim 1, wherein said protective outer layer is from about 0.5 to about 4 mils in thickness.

13. A structure comprising a copper substrate selected from the group consisting of OFHC copper, copper alloys, microcomposited copper, and graphite-reinforced copper alloys, a cobalt alloy diffusion barrier comprising cobalt, 21.0 weight percent chromium, 0.45 weight percent carbon, 1.75 weight percent iron, 11.0 weight percent tungsten, and 2.0 weight percent niobium or tantalum, said diffusion barrier being from about 0.1 to about 2 mils in thickness, and a protective outer layer consisting essentially of copper, from about 1 to about 8 weight percent aluminum, and from 0 to about 5 weight percent silicon.

14. A structure as set forth in claim 13, wherein said protective outer layer is from about 0.5 to about 4 mils in thickness.

15. An oxidation resistant heat exchange surface comprising a copper substrate having a cobalt alloy diffusion barrier comprising cobalt, 20 weight percent chromium, 10 weight percent nickel, 0.10 weight percent carbon, 15 weight percent tungsten, and 1.5 weight percent manganese, and a protective outer layer thereupon, said layer consisting essentially of copper and from about 1 to about 8 weight percent aluminum.

16. An oxidation resistant heat exchange surface comprising a copper substrate having a cobalt alloy diffusion barrier comprising cobalt, 21.0 weight percent chromium, 0.45 weight percent carbon, 1.75 weight percent iron, 11.0 weight percent tungsten, and 2.0 weight percent niobium or tantalum, and a protective outer layer thereupon, said layer consisting essentially of copper and from about 1 to about 8 weight percent aluminum.

* * * * *